US010859093B2

(12) United States Patent
Tamaoka et al.

(10) Patent No.: US 10,859,093 B2
(45) Date of Patent: Dec. 8, 2020

(54) BLOWER

(71) Applicant: NIDEC CORPORATION, Kyoto (JP)

(72) Inventors: Takehito Tamaoka, Kyoto (JP); Masashi Hirayama, Kyoto (JP); Naruyuki Horaitani, Kyoto (JP); Shun Hirano, Kyoto (JP); Takayuki Ito, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 75 days.

(21) Appl. No.: 15/875,081

(22) Filed: Jan. 19, 2018

(65) Prior Publication Data

US 2018/0202456 A1 Jul. 19, 2018

Related U.S. Application Data

(60) Provisional application No. 62/448,165, filed on Jan. 19, 2017.

(30) Foreign Application Priority Data

May 15, 2017 (JP) ..... 2017-096607

(51) Int. Cl.

| | |
|---|---|
| ***F04D 29/30*** | (2006.01) |
| ***F04D 29/28*** | (2006.01) |
| ***F04D 29/42*** | (2006.01) |
| ***F04D 25/06*** | (2006.01) |

(Continued)

(52) U.S. Cl.

CPC ..... *F04D 29/30* (2013.01); *F04D 25/0606* (2013.01); *F04D 29/281* (2013.01); *F04D 29/282* (2013.01); *F04D 29/4206* (2013.01); *F04D 29/4226* (2013.01); *F04D 17/16* (2013.01); *F04D 25/02* (2013.01)

(58) Field of Classification Search

CPC ..... F04D 29/282

See application file for complete search history.

(56) References Cited

U.S. PATENT DOCUMENTS

| | | | | |
|---|---|---|---|---|
| 7,381,027 | B2 | 6/2008 | Kaneko et al. | |
| 9,255,585 | B2 * | 2/2016 | Chen | F04D 17/16 |
| 9,416,793 | B2 * | 8/2016 | Chiou | F04D 17/16 |

(Continued)

FOREIGN PATENT DOCUMENTS

| | | | |
|---|---|---|---|
| CN | 100400893 | C | 7/2008 |
| JP | 2003-206890 | A | 7/2003 |

(Continued)

*Primary Examiner* — David E Sosnowski
*Assistant Examiner* — Jason G Davis
(74) *Attorney, Agent, or Firm* — Westerman, Hattori, Daniels & Adrian, LLP

(57) ABSTRACT

A blower includes an impeller rotatable about a central axis, a motor that drives the impeller, and a housing that accommodates the impeller and the motor. The impeller includes a plurality of vanes arrayed in a circumferential direction and a flange in which the plurality of vanes are provided at an outer circumferential edge on a radially outer side. The housing includes a first housing that faces a vane lower end surface located on an axial-direction lower side of the vane with a gap interposed therebetween. The vane lower end surface includes a first vane end surface in which a shortest distance to the first housing in an axial direction increases toward the radially outer side.

16 Claims, 12 Drawing Sheets

(51) Int. Cl.
*F04D 25/02* (2006.01)
*F04D 17/16* (2006.01)

(56) References Cited

U.S. PATENT DOCUMENTS

| | | | | |
|---|---|---|---|---|
| 9,846,462 | B2 * | 12/2017 | Chen | G06F 1/203 |
| 10,161,405 | B2 * | 12/2018 | Tamaoka | F04D 25/0613 |
| 2005/0249604 | A1 * | 11/2005 | Wu | F04D 29/30 416/244 R |
| 2008/0118345 | A1 * | 5/2008 | Choi | F04D 25/12 415/58.4 |

FOREIGN PATENT DOCUMENTS

| | | | |
|---|---|---|---|
| JP | 2003-206891 | A | 7/2003 |
| JP | 2004-353496 | A | 12/2004 |
| KR | 10-2004-0104370 | A | 12/2004 |
| TW | I280323 | B | 5/2007 |

* cited by examiner

BLOWER

FIELD OF THE INVENTION

The present invention relates to a blower.

DESCRIPTION OF THE RELATED ART

There has been known a blower that blows air to a radially outer direction by rotating an impeller including a plurality of vanes about an axial direction using a motor. For example, Unexamined Japanese Patent Publication No. 2004-353496 proposes a low-profile fan motor including a multi-blade centrifugal impeller that rotates integrally with a rotor of the motor. A blade of the impeller is formed in a top surface of an annular main plate. For example, the blower of Unexamined Japanese Patent Publication No. 2004-353496 is used as a cooling fan for an electronic device in which thinning is required.

SUMMARY OF THE INVENTION

However, with thinning of the blower, a gap between a plurality of vanes and a housing that accommodates the impeller and the motor is narrowed. For this reason, there is a risk that the vane contacts with the housing when the impeller fluctuates in an axial direction. In Unexamined Japanese Patent Publication No. 2004-353496, there is no description on this problem.

An object of the present invention is to provide a blower that can prevent a leading end of the vane from contacting with the housing.

In order to achieve the object, a blower according to one aspect of the present invention includes an impeller rotatable about a central axis, a motor that drives the impeller, and a housing that accommodates the impeller and the motor. The impeller includes a plurality of vanes arrayed in a circumferential direction and a flange in which the plurality of vanes are provided at an outer circumferential edge on a radially outer side, the housing includes a first housing that faces a vane lower end surface located on an axial-direction lower side of the vane with a gap interposed therebetween, and the vane lower end surface includes a first vane end surface in which a shortest distance to the first housing in an axial direction increases toward the radially outer side.

In the illustrative blower of the present invention, the leading end of the vane can be prevented from contacting with the housing.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
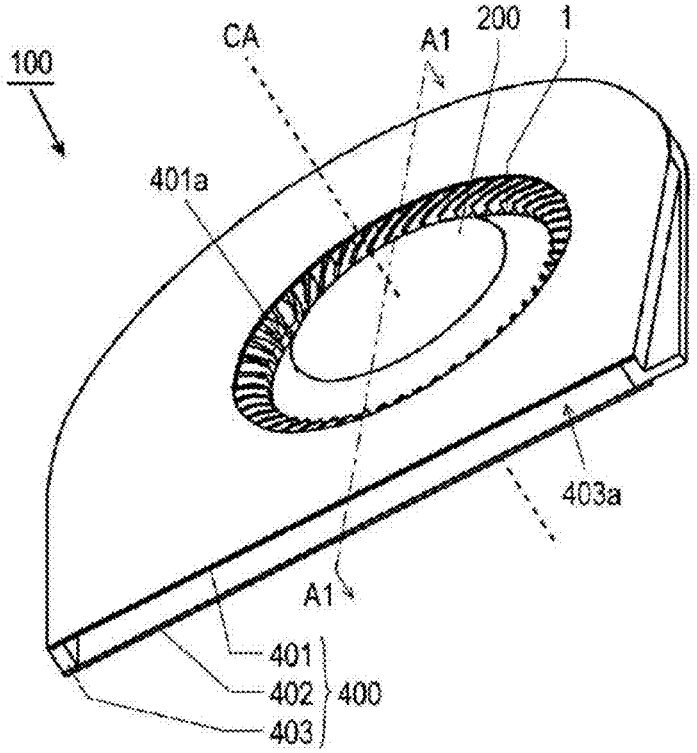
FIG. 1 is a perspective view illustrating an example of a blower.

Hereinafter, an exemplary embodiment of the present invention will be described with reference to the drawings.

In a blower 100 of the specification, a direction parallel to a central axis CA is called an "axial direction". In the axial direction, a direction from an inlet plate 401 (to be described later) toward a support plate 402 (to be described later) is called an "axial-direction lower side" as one side in the axial direction. In the axial direction, a direction from the support plate 402 toward the inlet plate 401 is called an "axial-direction upper side" as the other side in the axial direction. In each component, an end on the axial-direction lower side is called a "lower end", and an end on the axial-direction upper side is called an "upper end". An end surface located on the axial-direction lower side is called a "lower end surface" as an one-side end surface located on one side of the axial direction, and an end surface located on the axial-direction upper side is called an "upper end surface" as the-other-side end surface located on the other side of the axial direction.

A direction orthogonal to the central axis CA is called a "radial direction". In the radial direction, a direction toward the central axis CA is called a "radially inner side", and a direction away from the central axis CA is called a "radially outer side". In a side surface of each component, a side surface located on a radially inner side is called an "inside surface", and a side surface located on a radially outer side is called an "outside surface". An end on the radially inner side is called an "inner end", and an end on the radially outer side is called an "outer end". More specifically, when viewed in the axial direction, the "inner end" in the radial direction overlaps the "inside surface", and the "outer end" in the radial direction overlaps the "outside surface". A portion, which is located on the radially inner side with respect to the "outer end" in the radial direction and near the "outer end" in the radial direction, is called an "outer circumferential edge".

A circumferential direction centered around the central axis CA is called a "circumferential direction". One side in the circumferential direction is identical to a direction of an impeller 200 (to be described later) and a rotation direction Dro of a vane 1, and the other side in the circumferential direction is identical to an opposite side to the rotation direction Dro. In each component, a side surface located on the opposite side to the rotation direction Dro in the circumferential direction is called a "rear edge surface", and a side surface located on the side of the rotation direction Dro in the circumferential direction is called a "front edge surface".

Names of the direction, the surface, and the component do not express a positional relationship and the direction in the case that the blower 100 is incorporated in an actual device.

1. Embodiment

1-1. Schematic Configuration of Blower

Figure 2:
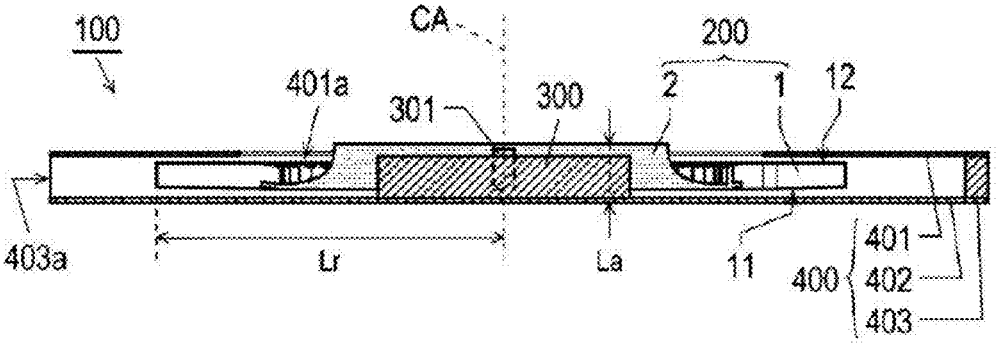
FIG. 2 is a sectional view illustrating a configuration example of the blower.

FIG. 1 is a perspective view illustrating an example of the blower 100. FIG. 2 is a sectional view illustrating a configuration example of the blower 100. FIG. 2 illustrates a section along an alternate long and short dash line A1-A1 of the blower 100, which is cut by a plane including the central axis CA in FIG. 1.

The blower 100 includes the impeller 200, a motor 300, and a housing 400.

The impeller 200 is one in which a plurality of vanes 1 are provided, and the impeller 200 is attached to the motor 300. The impeller 200 is rotatable about the central axis CA together with a shaft 301 of the motor 300. A shortest distance Lr in the radial direction from the central axis CA to the outer end (that is, a leading end) on the radially outer side of the vane 1 is larger than an axial direction length La of the blower 100, preferably at least five times the axial direction length La. This enables production of the low-profile blower 100. A configuration of the impeller 200 will be described later.

The motor 300 rotates the shaft 301 about the central axis CA to drive the impeller 200.

The housing 400 accommodates the impeller 200 and the motor 300. The housing 400 includes the inlet plate 401, the support plate 402, and a sidewall 403.

The inlet plate 401 is provided on the axial-direction upper side with respect to the plurality of vanes 1, and faces a vane upper end surface 12 located on the axial-direction upper side of the vane 1 with a gap interposed therebetween. The inlet plate 401 includes an inlet port 401*a* piercing in the axial direction.

The support plate 402 is provided on the axial-direction lower side with respect to the plurality of vanes 1, faces a vane lower end surface 11 located on the axial-direction lower side of the vane 1 with a gap interposed therebetween, and supports the motor 300. More specifically, the motor 300 is fixed to a top surface of the support plate 402. The top surface of the support plate 402 faces a bottom surface of the inlet plate 401 in the axial direction.

The sidewall 403 is provided between the bottom surface of the inlet plate 401 and the top surface of the support plate 402, and forms an internal space in which the impeller 200 and the motor 300 are accommodated, together with the inlet plate 401 and the support plate 402. A blowing port 403*a* opened toward the radial direction is provided in the sidewall 403. The internal space of the housing 400 accommodates the impeller 200 and the motor 300, and is communicated with the outside of the housing 400 through the inlet port 401*a* and the blowing port 403*a*.

There is no particular limitation on materials of the inlet plate 401, the support plate 402, and the sidewall 403. For example, the inlet plate 401, the support plate 402, and the sidewall 403 are made of metal. By way of example, the inlet plate 401 and the support plate 402 are made of stainless steel, and the sidewall 403 is made of copper. The sidewall 403 is formed by forging, casting, or press working, and the inlet plate 401 and the support plate 402 are formed by insert molding or outsert molding. After the forming, the housing 400 is machined in order to guarantee shape accuracy.

Wind generated by the rotation of the impeller 200 directly hits the sidewall 403. Preferably, the sidewall 403 has high heat conductivity of, for example, at least 100 [W/m·K]. Consequently, even if air having a relatively high temperature flows into the blower 100, heat of the air blown onto the radially outer side by the rotation of the impeller 200 can effectively be radiated by the sidewall 403. This effect is particularly effective in the case that the blower 100 is used as a cooling fan.

1-2. Configuration of Impeller

Figure 3:
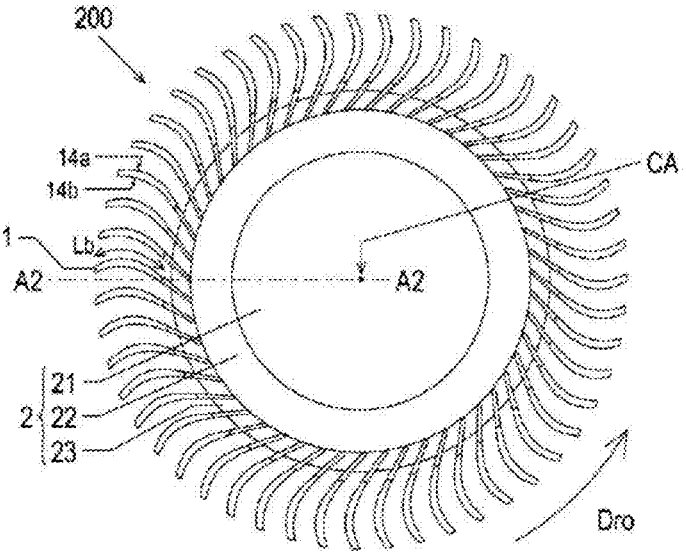
FIG. 3 is a top view illustrating an example of an impeller.
Figure 4:
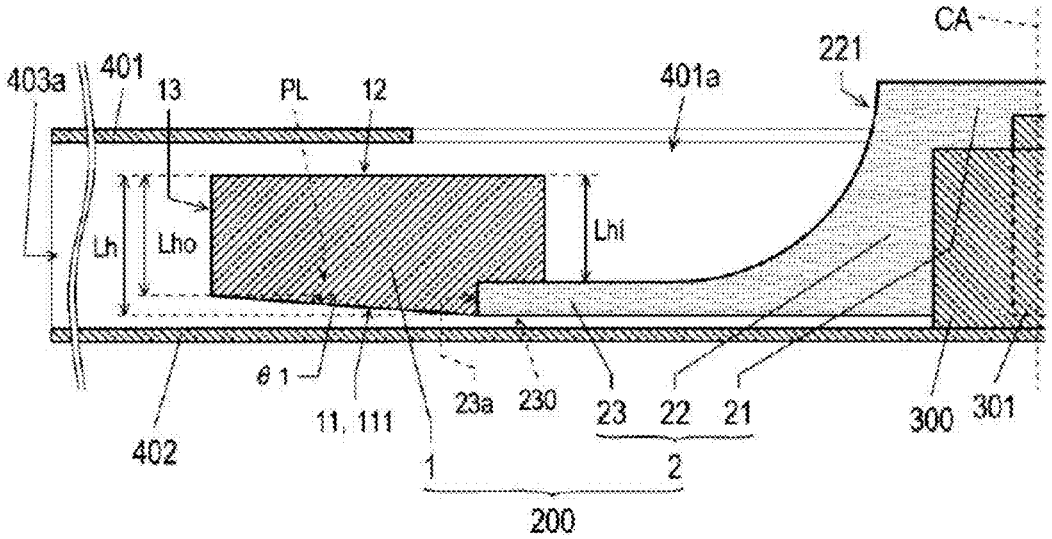
FIG. 4 is a sectional view illustrating an example of the blower when the blower is viewed in a circumferential direction.

A configuration of the impeller 200 will be described below. FIG. 3 is a top view illustrating an example of the impeller 200. FIG. 4 is a sectional view illustrating an example of the blower 100 when the blower 100 is viewed in the circumferential direction. FIG. 4 corresponds to the section of the blower 100 along the alternate long and short dash line A1-A1 in FIG. 1 and the section of the impeller 200 along an alternate long and short dash line A2-A2 in FIG. 3.

The impeller 200 includes the plurality of vanes 1, a cover 21, a cylindrical unit 22, and a flange 23. The cover 21, the cylindrical unit 22, and the flange 23 constitute a cup 2. That is, the impeller 200 includes the cup 2. The cup 2 accommodates the upper end of the motor 300 on the axial-direction upper side therein, namely, the cup 2 is attached to the upper end of the motor 300.

The plurality of vanes 1 are arrayed in the circumferential direction. Preferably, a number of vanes 1 is a prime number in order to prevent a noise, which is generated when the vane 1 scratches air. For example, preferably the number of vanes 1 is at least 31. Because a gap between the vanes 1 is narrowed according to the number of vanes 1, a static pressure between the vanes 1 increases, and the air between the vanes 1 is sent more vigorously onto the radially outer side. Thus, blowing efficiency of the blower 100 is improved. A configuration of the vane 1 will be described later.

The cover 21 is coupled to the shaft 301, and covers the top surface of the motor 300. The cylindrical unit 22 extends from the outer end on the radially outer side of the cover 21 toward at least the axial-direction lower side. The cover 21 and the cylindrical unit 22 constitute the internal space in which the upper end on the axial-direction upper side of the motor 300 is accommodated. The outside surface of the cylindrical unit 22 includes a curved surface 221. In sectional view from the circumferential direction, the curved surface 221 is oriented toward the axial-direction upper side and the radially outer side, and recessed on the opposite side to the direction in which the curved surface 221 is oriented. A center of curvature of the curved surface 221 is located on the side of the direction in which the curved surface 221 is oriented with respect to the curved surface 221. Thus, the air flows smoothly onto the radially outer side along the curved surface 221, and leads to the flange 23. The flange 23 extends from the outer end on the radially outer side of the cylindrical unit 22 toward the radially outer side. The plurality of vanes 1 are provided at an outer circumferential edge 230 on the radially outer side of the flange 23.

During the rotation of the impeller 200, the air flowing into the internal space of the housing 400 through the inlet port 401*a* flows onto the radially outer side along the curved surface 221 and the top surface of the flange 23, and flows between the plurality of vanes 1. The air becomes the wind by the plurality of vanes 1 rotating in the circumferential direction, flows onto the radially outer side of the impeller 200, and is sent to the outside of the housing 400 through the blowing port 403*a*.

Figure 5A:
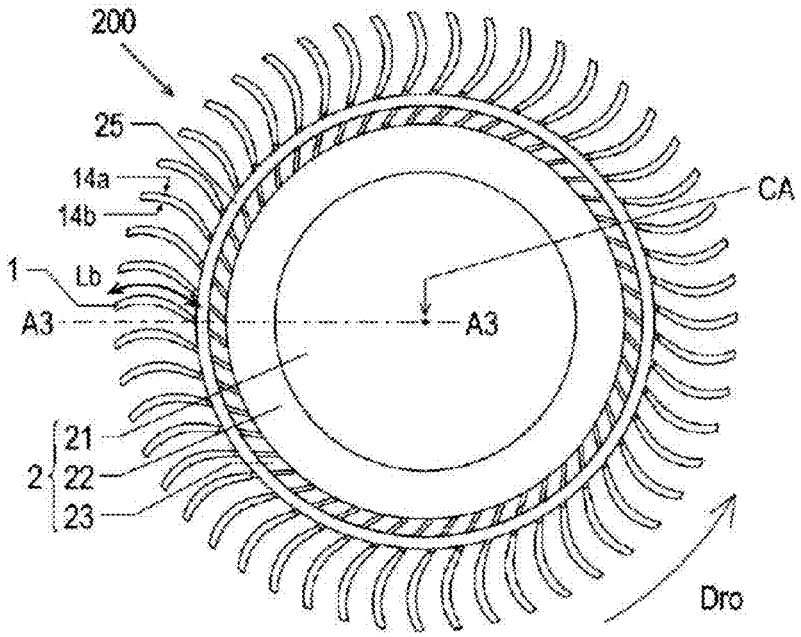
FIG. 5A is a top view illustrating another example of the impeller.
Figure 5B:
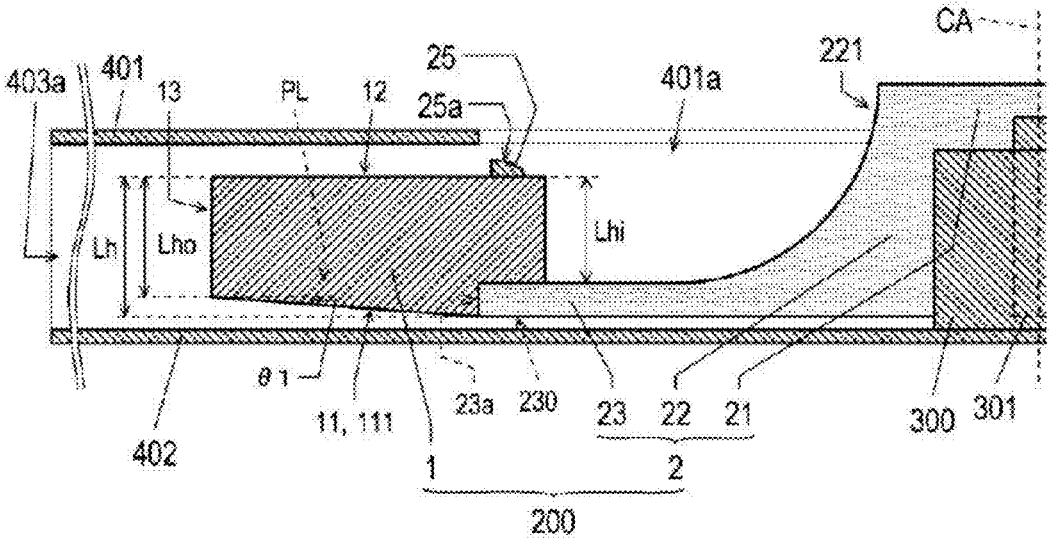
FIG. 5B is a sectional view illustrating another example of the blower when the blower is viewed in the circumferential direction.

The impeller 200 is not limited to the illustrations in FIGS. 3 and 4, but may further include an annular ring 25. FIG. 5A is a top view illustrating another example of the impeller 200. FIG. 5B is a sectional view illustrating another example of the blower 100 when the blower 100 is viewed in the circumferential direction. FIG. 5B corresponds to the section of the blower 100 along the alternate long and short dash line A1-A1 in FIG. 1 and the section of the impeller 200 along an alternate long and short dash line A3-A3 in FIG. 5A.

In FIGS. 5A and 5B, the annular ring 25 is coupled to the plurality of vanes 1 on the axial-direction upper side of the vane 1. However, the annular ring 25 is not limited to the illustrations in FIGS. 5A and 5B, but may be coupled to the plurality of vanes 1 on the axial-direction lower side of the vane 1. That is, the annular ring 25 may be provided on at least one of the axial-direction upper side and the axial-direction lower side of the vane 1, and coupled to the plurality of vanes 1 on the at least one side. The annular ring 25 is coupled to the plurality of vanes 1, which allows improvement of strength of each vane 1 provided in the impeller 200. The annular ring 25 provided on the axial-direction upper side with respect to the vane 1 can prevent counter flow of the air temporarily drawn from the inlet port 401*a* toward the inlet port 401*a*. For example, when the annular ring 25 is provided on the axial-direction lower side with respect to the vane 1 while another inlet port (not illustrated) is provided in the support plate 402, the annular ring 25 provided on the axial-direction lower side with respect to the vane 1 can prevent the counter flow of the air temporarily drawn from another inlet port toward another inlet port.

The annular ring 25 includes a curved surface 25*a*. In sectional view from the circumferential direction, the curved surface 25*a* has a curved shape projecting toward the axial-direction upper side and the radial-direction inside. Consequently, the air drawn through the inlet port 401*a* flows along the curved surface 25*a* of the annular ring 25. Drawing efficiency is improved because the air flow is hardly separated from the curved surface 25*a*.

The configuration of the vane 1 will be described below with reference to FIGS. 3 and 4. As illustrated in FIGS. 3 and 4, each vane 1 extends from an outer circumferential edge 230 of the flange 23 toward at least the radially outer side. For this reason, the more vanes 1 can be arrayed in the circumferential direction compared with the case that the plurality of vanes 1 extend from an inner circumferential edge of the flange 23.

The inner end in the radially inner side of the vane 1 overlaps inlet port 401*a* when viewed from axial direction. Consequently, the vane 1 can scratch the air drawn from the inlet port 401*a*, and generate the wind. An area in which the vane 1 scratches the air is enlarged compared with the case that the inner end in the radially inner side of the vane 1 is located on the radially outer side with respect to the inlet port 401*a*, so that vane 1 can generate a more amount of wind. Thus, the drawing efficiency at the inlet port 401*a* can be improved, and airflow of the blower 100 can further be increased.

The inner end in the radial-direction inside of the vane 1 projects from the flange 23 toward the axial direction upper side at the outer circumferential edge 230 of the flange 23. The inner end of the vane 1 projects at the outer circumferential edge 230 when viewed from the axial direction, so that the number of vanes 1 provided in the circumferential direction can be increased compared with the case that the inner end is located in a central portion of the impeller 200. Thus, the airflow of the blower 100 is easily increased.

As illustrated in FIG. 3, each vane 1 is curved in the circumferential direction when viewed from the axial direction. More specifically, each vane 1 has a curved shape projecting toward the opposite direction to the rotation direction Dro in the circumferential direction. As illustrated in FIGS. 3 and 4, when viewed from the axial direction, a length Lb along the vane 1 from an outside surface 23*a* located on the radially outer side of the flange 23 to the outer end on the radially outer side of the vane 1 is longer than a length Lh in the axial direction of the vane 1 in the outside surface 23*a* located on the radially outer side of the flange 23. In other words, the length Lh is a maximum value Lh of the length in the axial direction of the vane 1, and the length Lb along the vane 1 is longer than the maximum length Lh in the axial direction. Consequently, the low profile of the vane 1 of the impeller 200 can further be achieved, and downsize the blower 100.

An axial-direction length Lho at the outer end on the radially outer side of the vane 1 is larger than an axial-direction length Lhi at the inner end on the radially inner side of the vane 1. The area in which the vane 1 scratches the air is further enlarged, so that the vane 1 can generate a more amount of wind. Thus, the airflow of the blower 100 can be increased.

Each vane 1 is made of resin. In the embodiment, all the vanes 1 become a part of the same member as the flange 23. However, the vanes 1 are not limited to the embodiment. Alternatively, a part or all of the vanes 1 may be made of resin, and be a member different from the flange 23. That is, a part of the vanes 1 may be made of resin, and be a part of the same member as the flange 23. Alternatively, all of the vanes 1 may be a member different from the flange 23. However, preferably at least one of the plurality of vanes 1 is made of resin, and is a part of the same member as the flange 23. Consequently, the number of production steps can be decreased compared with the case that all of the vanes 1 are the member different from the flange 23, so that time (for example, a yield cycle time) necessary for the production can be shortened to improve production efficiency.

As illustrated in FIG. 4, each vane 1 includes the vane lower end surface 11 facing the support plate 402, the vane upper end surface 12 facing the inlet plate 401, and a vane outside surface 13. Each vane 1 also includes a rear edge surface 14*a* located on the opposite side to the rotation direction Dro of the impeller 200 in the circumferential direction and a front edge surface 14*b* located on the side of the rotation direction Dro of the impeller 200 in the circumferential direction. Because the front edge surface 14*b* of the vane 1 presses the air during the rotation of the impeller 200, a positive pressure is applied to the front edge surface 14*b* while a negative pressure is applied to the rear edge surface 14*a*. When viewed from the axial direction, the rear edge surface 14*a* and the front edge surface 14*b* of each vane 1 are curved toward the opposite side to the rotation direction Dro in the circumferential direction. Configurations of the vane outside surface 13 and the rear edge surface 14*a* will be described later.

In FIG. 4, the vane lower end surface 11 includes a first vane end surface 111. In the first vane end surface 111, a shortest distance to the support plate 402 in the axial direction increases gradually toward the radially outer side.

In this case, even if the impeller 200 fluctuates in the axial direction, the outer end (that is, the leading end) on the radially outer side of the vane 1 hardly contacts with the support plate 402. Thus, the leading end of the vane 1 can be prevented from contacting with the housing 400. This effect is particularly effective in the low-profile blower 100 having a small size in the axial direction, and reliability of the blower 100 can be improved.

When viewed from the circumferential direction, the first vane end surface 111 extends straight, and forms an acute angle θ1 with respect to a plane PL orthogonal to the central axis CA. For example, the acute angle θ1 ranges from 0.5 to 10 [degree]. Consequently, the vane lower end surface 11 of the vane 1 hardly contacts with the support plate 402 compared with the case that the first vane end surface 111 extends in the radial direction when viewed from the circumferential direction and the case that the first vane end surface 111 has a curved shape projecting toward the axial-direction lower side. A material used for the vane 1 is reduced compared with the above case, which contributes to reduction of production cost. The area in which the vane 1 scratches the air is not narrowed too much by setting the acute angle θ1 to the above range. Thus, the airflow generated by the scratching of the air using the vane 1 is not excessively decreased.

In FIG. 4, when viewed from the circumferential direction, the first vane end surface 111 extends from the outside surface 23*a* located on the radially outer side of the flange 23, and is inclined onto the radial-direction upper side with respect to the plane PL orthogonal to the central axis CA toward the radially outer side. Consequently, the shortest distance between the outer end on the radially outer side of the vane 1 and the support plate 402 can be increased by the inclination of the first vane end surface 111. That is, in the axial direction, the leading end of the vane 1 can further be separated from the support plate 402. Thus, the leading end of the vane 1 further hardly contacts with the housing 400.

In FIG. 4, when viewed from the circumferential direction, the first vane end surface 111 extends from the lower end on the axial-direction side of the outside surface 23*a* located on the radially outer side of the flange 23. Consequently, even if the first vane end surface 111 is provided in the vane 1, the area in which the vane 1 scratches the air is not reduced too much at the outer end on the radially outer side of the flange 23. Thus, a decrease in airflow due to a decrease in size of the vane 1 in the axial direction can be prevented.

In FIG. 4, when viewed from the circumferential direction, the first vans end surface 111 extends from the lower end on the axial-direction lower side of the outside surface 23*a* of the flange 23. However, the first vane end surface 111 is not limited to the illustration in FIG. 4. The first vane end surface 111 may extend from the upper end in the axial direction of the outside surface 23*a* of the flange 23, or extend from a position between the upper end and the lower end in the axial direction of the outside surface 23*a* of the flange 23.

In FIG. 4, the vane lower end surface 11 is the first vane end surface 111. However, the configuration of the vane lower end surface 11 is not limited to the illustration in FIG. 4. First to fourth modifications of the configuration of the vane lower end surface 11 will be described below with reference to FIGS. 6A to 6C.

Figure 6A:
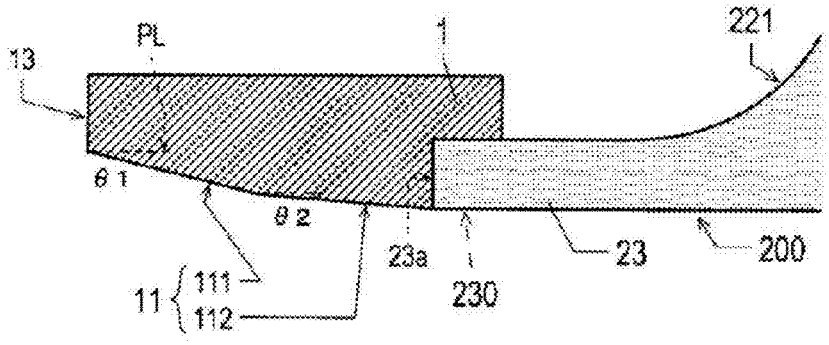
FIG. 6A is a view illustrating a first modification of a configuration of a vane lower end surface.

FIG. 6A is a view illustrating a first modification of the configuration of the vane lower end surface 11 in the vane 1. The vane lower end surface 11 in FIG. 6A further includes a second vane end surface 112 facing the support plate 402 in addition to the first vane end surface 111. When viewed from the circumferential direction, the second vane end surface 112 extends from the outside surface 23*a* located on the radially outer side of the flange 23 toward the axial-direction upper side and the radially outer side. The inner end on the radial-direction inside of the first vane end surface 111 is connected to the outer end on the radially outer side of the second vane end surface 112. Consequently, the leading end of the vane 1 can be separated from the support plate 402 in the axial direction while the decrease of the area in which the vane 1 scratches the air is prevented. Thus, the leading end of the vane 1 hardly contacts with the housing 400.

When viewed from the circumferential direction, the second vane end surface 112 extends straight, is inclined onto the axial-direction upper side with respect to the plane PL orthogonal to the central axis CA toward the radially outer side, and forms an acute angle θ2 with respect to the plane PL. Consequently, the vane lower end surface 11 of the vane 1 is hardly contacts with the support plate 402 compared with the case that the second vane end surface 112 has a curved shape of a second modification when viewed from the circumferential direction. There is no particular limitation on the acute angle θ2. For example, the acute angle θ2 is formed smaller than the acute angle θ1 between first vane end surface 111 and the radial direction in order to prevent the significant decrease of the area in which the vane 1 scratches the air.

Figure 6B:
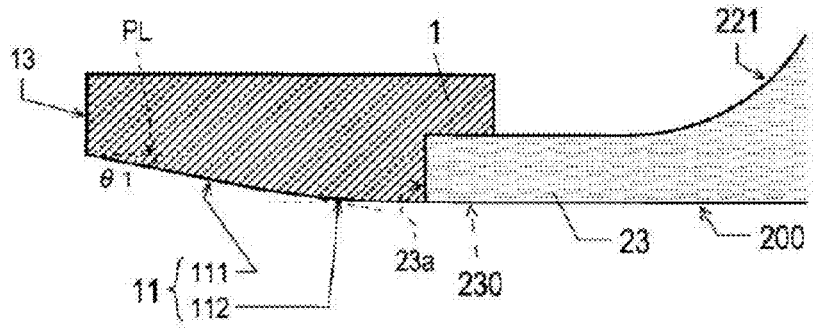
FIG. 6B is a view illustrating a second modification of the configuration of the vane lower end surface.

FIG. 6B is a view illustrating the second modification of the configuration of the vane lower end surface 11 in the vane 1. In FIG. 6B, the second vane end surface 112 has the curved shape projecting toward the radially outer side and the axial-direction lower side when viewed from the circumferential direction. The second modification differs from the first modification in this point. In the second modification, the area in which the vane 1 scratches the air can be enlarged to generate the more amount of wind compared with the case that the second vane end surface 112 has a shape extending straight like the first modification when viewed from the circumferential direction.

Figure 6C:
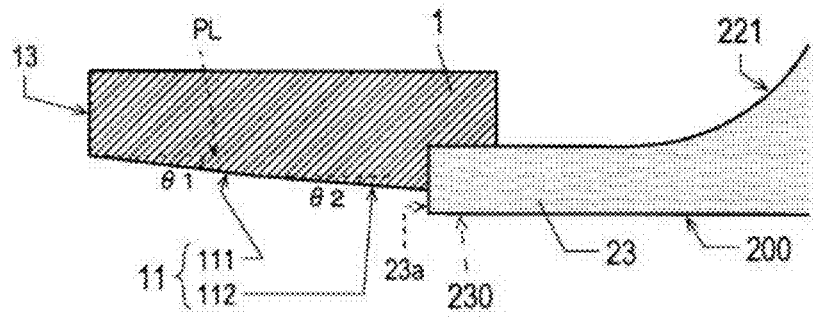
FIG. 6C is a view illustrating a third modification of the configuration of the vane lower end surface.

FIG. 6C is a view illustrating a third modification of the configuration of the vane lower end surface 11 in the vane 1. In FIG. 6C, when viewed from the circumferential direction, the second vane end surface 112 extends from a portion between both the ends (that is, a portion between the upper end and the lower end) in the axial direction of the outside surface 23*a* located on the radially outer side of the flange 23. The third modification differs from the first modification in this point. Even in the third modification, the outer end in the radial direction of the vane 1 can be separated from the support plate 402 in the axial direction. Thus, the leading end of the vane 1 further hardly contacts with the housing 400.

A configuration of the vane outside surface 13 of the vane 1 will be described below. The vane outside surface 13 extends from the outer end toward at least the axial-direction upper side in the radially outer side of the first vane end surface 111, as the third vane end surface.

Figure 7:
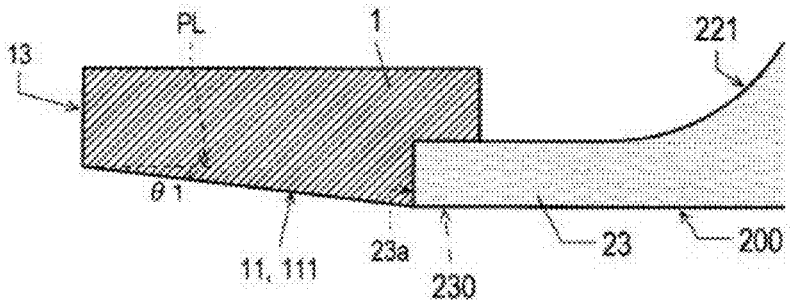
FIG. 7 is a view illustrating a configuration example of a vane outside surface.
Figure 8A:
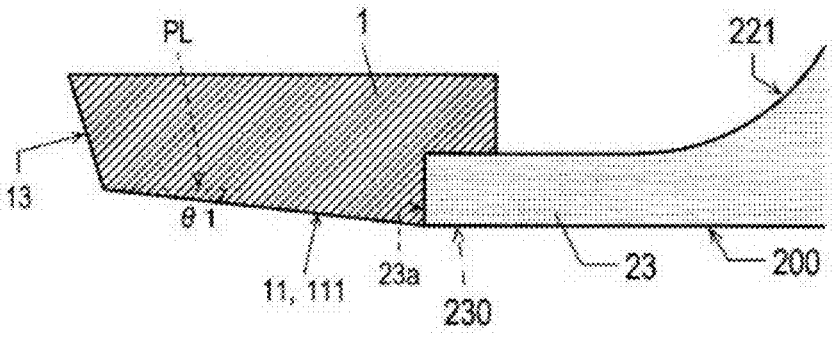
FIG. 8A is a view illustrating a first modification of a configuration of the vane outside surface.
Figure 8B:
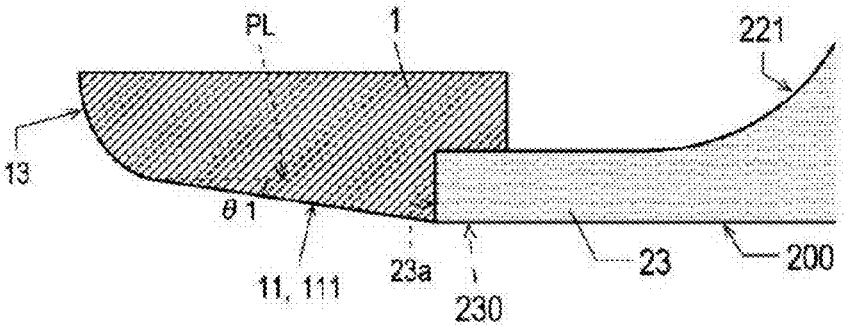
FIG. 8B is a view illustrating a second modification of a configuration of the vane outside surface.

FIG. 7 is a view illustrating a configuration example of the vane outside surface 13. In FIG. 7, the vane outside surface 13 is parallel to the axial direction, and extends straight toward the axial-direction upper side when viewed from the circumferential direction. The configuration of the vane outside surface 13 is not limited to the illustration in FIG. 7. As illustrated in FIG. 8A, when viewed from the circumferential direction, the vane outside surface 13 may extend straight, and be inclined onto the axial-direction upper side with respect to the plane PL orthogonal to the central axis CA toward the radially outer side. Alternatively, as illustrated in FIG. 8B, the vane outside surface 13 may have the curved shape projecting toward the radially outer side and the axial-direction lower side when viewed from the circumferential direction.

Figure 9:
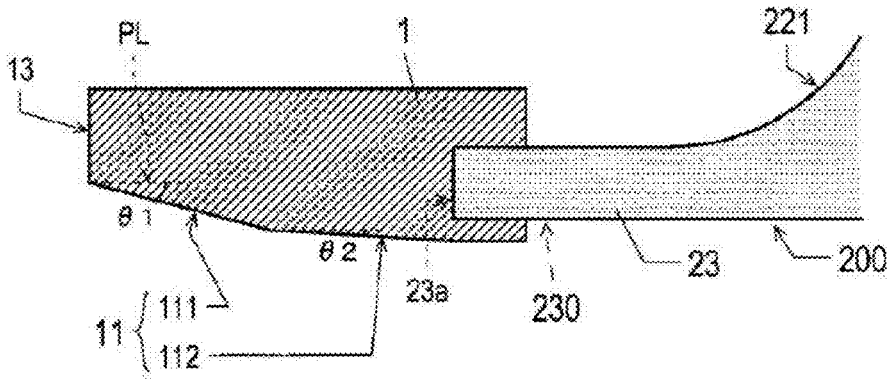
FIG. 9 is a view illustrating another configuration example of an inner end in an inside in the circumferential direction of the vane.

In FIGS. 4 to 8B, the inner end on the radially inner side of the vane 1 projects from the outer circumferential edge 230 of the flange 23 only toward the axial-direction upper side. However, the inner end is not limited to the illustrations in FIGS. 4 to 8B, but may also project toward the axial-direction lower side. FIG. 9 is a view illustrating another configuration example of the inner end of the vane 1. In FIG. 9, when viewed from the circumferential direction, the inner end on the radially inner side of the vane 1 projects from the flange 23 toward the axial-direction lower side at the outer circumferential edge 230 of the flange 23. In the vane lower end surface 11, when viewed from the axial direction, the second vane end surface 112 may extend from the position on the radially outer side with respect to the outside surface 23*a* of the flange 23 toward the radially inner side or the radially outer side, extend from the radially inner side or the radially outer side, or extend from the position on the radially inner side with respect to the outside surface 23*a* toward the radially inner side or the radially outer side. The configuration in FIG. 9 enlarges the area in which the vane 1 scratches the air, and the more amount of wind can be generated. In the case that another inlet port (not illustrated) is also provided in the support plate 402, because the air can efficiently be drawn from another inlet port of the support plate 402, the airflow of the blower 100 is easy to increase.

1-3-4. Configuration of Rear Edge Surface

Figure 10A:
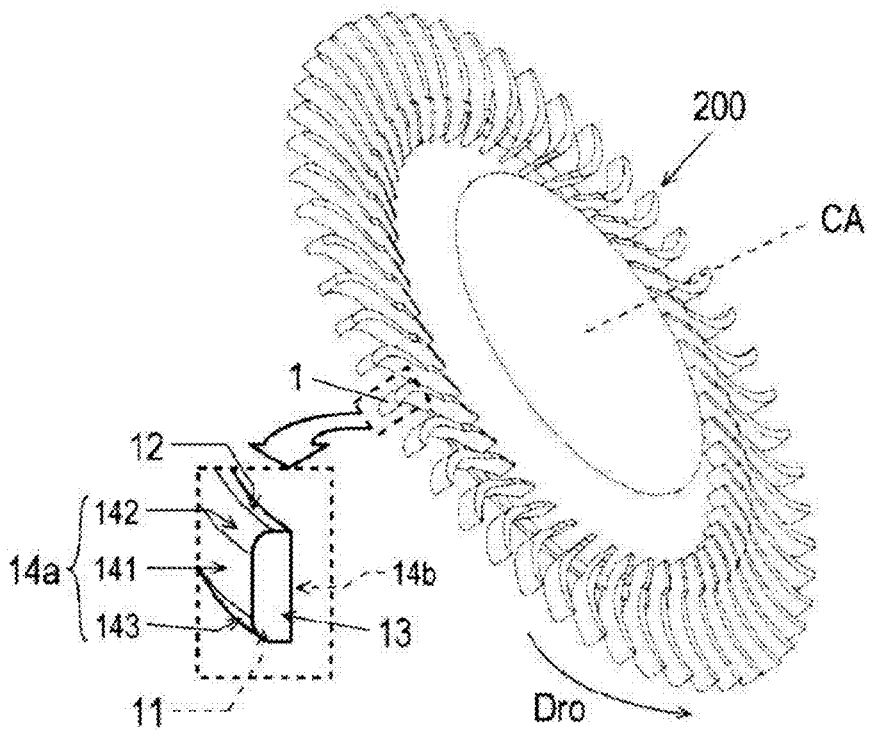
FIG. 10A is a view illustrating a configuration of a rear edge surface of the vane on an opposite side to a rotation direction.
Figure 10B:
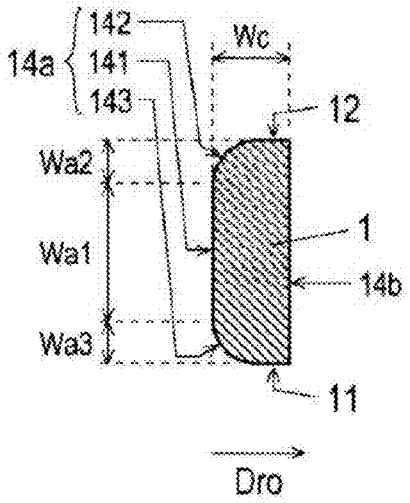
FIG. 10B is a sectional view of the vane when the vane is viewed from a direction in which the vane extends.

A configuration of the rear edge surface 14*a* of the vane 1 will be described below. FIG. 10A is a view illustrating a configuration of the rear edge surface 14*a* of the vane 1 on an opposite side to the rotation direction Dro. FIG. 10B is a sectional view of the vane 1 when the vane 1 is viewed from a direction in which the vane 1 extends.

As illustrated in FIGS. 10A and 10B, the rear edge surface 14*a* includes a rear surface 141, a first curved surface 142, and a second curved surface 143. In planar view from the axial direction, the rear surface 141, the first curved surface 142, and the second curved surface 143 have the curved shape projecting toward the opposite side to the rotation direction Dro in the circumferential direction.

In sectional view from the direction in which the vane 1 extends, the rear surface 141 extends straight, and is parallel to the axial direction.

In sectional view from the direction, in which the vane 1 extends, the first curved surface 142 has the curved shape projecting the opposite side to the rotation direction Dro in the circumferential direction and the axial-direction upper side, and is connected to the upper end surface 12 of the vane 1 and the upper end on the axial-direction upper side of the rear surface 141. More specifically, in sectional view from the direction in which the vane 1 extends, the first curved surface 142 has the curved shape projecting toward the axial-direction upper side and the opposite side to the rotation direction Dro in the circumferential direction. The upper end on the axial-direction upper side of the first curved surface 142 is coupled to the end on the opposite side to the rotation direction Dro in the circumferential direction of the vane upper end surface 12. The lower end on the axial-direction lower side of the first curved surface 142 is coupled to the upper end on the axial-direction upper side of the rear surface 141.

Preferably, the first curved surface 142 is smoothly connected to the vane upper end surface 12 and the rear surface 141. More specifically, in sectional view from the direction in which the vane 1 extends, preferably a tangential direction of the first curved surface 142 at the upper end in the axial direction is parallel to a tangential direction of the vane upper end surface 12 at the end on the opposite side to the rotation direction Dro in the circumferential direction. In sectional view from the direction in which the vane 1 extends, preferably the tangential direction of the first curved surface 142 at the lower end in the axial direction is parallel to the rear surface 141. Consequently, the rapid change can be prevented in the flowing direction of the air flowing from the vane upper end surface 12 to the first curved surface 142. The rapid change can also be prevented in the flowing direction of the air flowing from the first curved surface 142 to the rear surface 141. This enables the contribution to the prevention of the noise generated by providing the first curved surface 142 in the rear edge surface 14*a*.

In sectional view from the direction in which the vane 1 extends, the second curved surface 143 has the curved shape projecting toward the opposite side to the rotation direction Dro in the circumferential direction and the axial-direction lower side, and is connected to the lower end surface 11 of the vane 1 and the lower end on the axial-direction lower side of the rear surface 141. More specifically, in sectional view from the direction in which the vane 1 extends, the second curved surface 143 has the curved shape projecting toward the axial-direction lower side and the opposite side to the rotation direction Dro in the circumferential direction. The lower end on the axial-direction lower side of the second curved surface 143 is coupled to the end on the opposite side to the rotation direction Dro in the circumferential direction of the vane lower end surface 11. The upper end on the axial-direction upper side of the second curved surface 143 is coupled to the lower end on the axial-direction lower side of the rear surface 141.

Preferably, the second curved surface 143 is smoothly coupled to the vane lower end surface 11 and the rear surface 141. More specifically, in sectional view from the direction in which the vane 1 extends, preferably the tangential direction of the second curved surface 143 at the upper end in the axial direction is parallel to the rear surface 141. In sectional view from the direction in which the vane 1 extends, preferably the tangential direction of the second curved surface 143 at the lower end in the axial direction is parallel to the tangential direction of the vane lower end surface 11 at the end on the opposite side to the rotation direction Dro in the circumferential direction. Consequently, the rapid change can be prevented in the flowing direction of the air flowing from the vane lower end surface 11 to the second curved surface 143. The rapid change can also be prevented in the flowing direction of the air flowing from the second curved surface 143 to the rear surface 141. This enables the contribution to the prevention of the noise generated by providing the second curved surface 143 in the rear edge surface 14*a*.

In FIG. 10B, in sectional view from the direction in which the vane 1 extends, for example, a width (Wa1+Wa2+ Wa3) is 1.4 [mm] in the axial direction of the vane 1. For example, a width Wa1 is 0.8 [mm] in the axial direction of the rear surface 141. For example, a width Wa2 is 0.3 [mm] in the axial direction of the first curved surface 142, and a width Wa3 is 0.3 [mm] in the axial direction of the second curved surface 143.

In sectional view from the direction in which the vane 1 extends, a thickness of the vane 1 in the direction in which the vane 1 extends and the direction perpendicular to the axial direction is kept constant at a range of, for example, 0.25 to 0.8 [mm]. In the embodiment, the vane 1 has a thickness Wc of 0.5 [mm]. The strength of the vane 1 can be maintained by setting the thickness of the vane 1 to proper values.

Figure 11A:
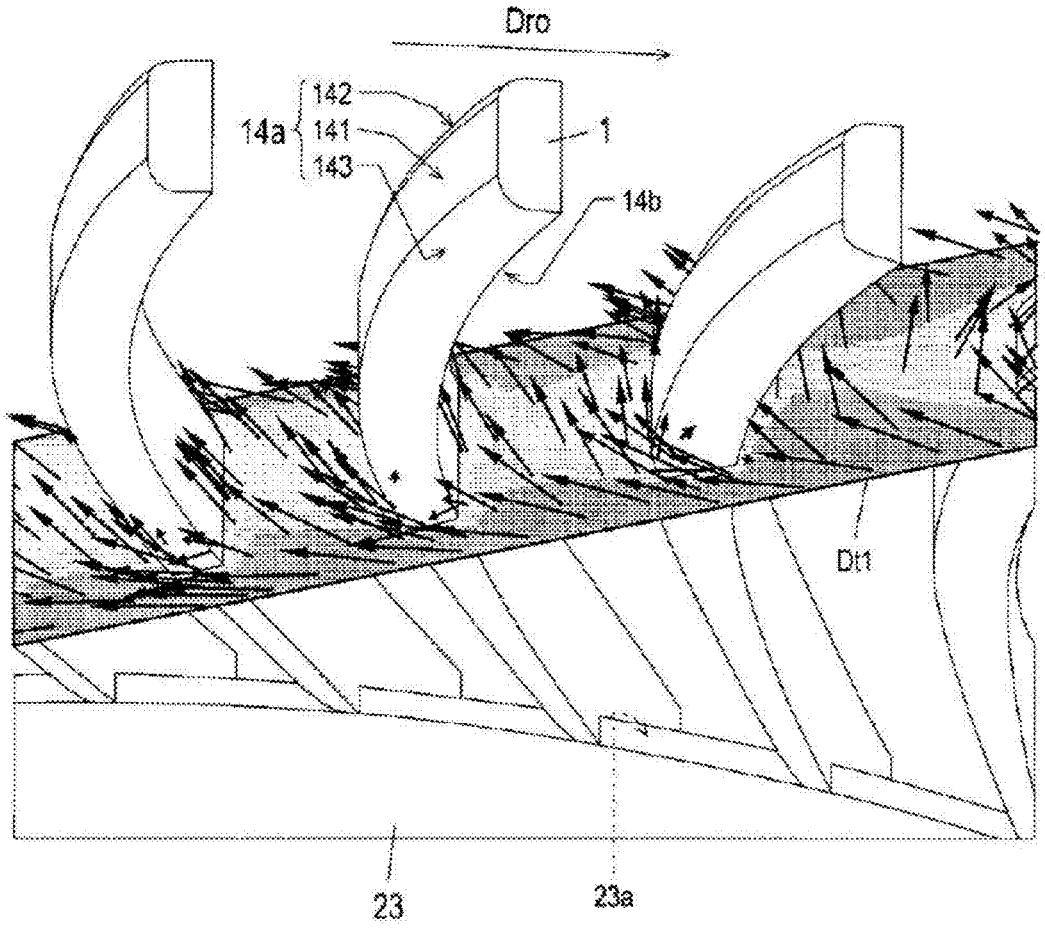
FIG. 11A is a view illustrating a distribution of a noise generated near the vane in which a first curved surface and a second curved surface are provided in the rear edge surface.
Figure 11B:
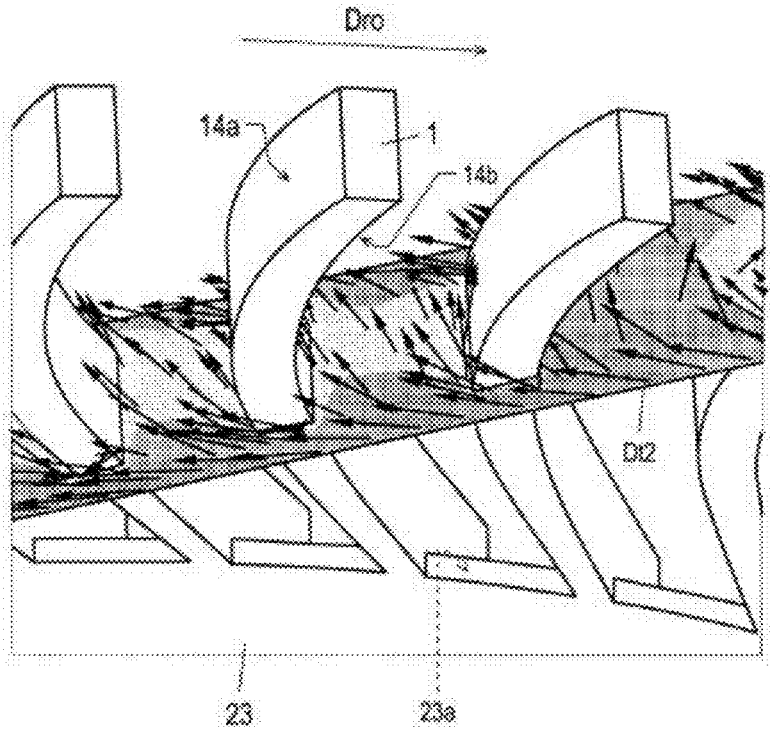
FIG. 11B is a view illustrating a distribution of the noise generated near the vane in which the first curved surface and the second curved surface are not provided in the rear edge surface.

The first curved surface 142 and the second curved surface 143 are provided in the rear edge surf ace 14*a* in order to prevent the noise generated by a wind noise of the vane 1 during the rotation of the impeller 200. FIGS. 11A and 11B illustrate results in which a distribution of the noise generated near the vane 1 is analyzed by computer simulation. FIG. 11A is a view illustrating a distribution Dt1 of the noise generated near the vane 1 in which the first curved surface 142 and the second curved surface 143 are provided in the rear edge surface 14*a*. FIG. 11B is a view illustrating a distribution Dt2 of the noise generated near the vane 1 in which the first curved surface 142 and the second curved surface 143 are not provided in the rear edge surface 14*a*. In the noise distribution Dt1 of FIG. 11A and the noise distribution Dt2 of FIG. 11B, the depth of color of a region expresses noise intensity. That is, a larger noise is generated with the denser color of the region. In FIGS. 11 A and 11B, arrows express the flowing direction of the air.

A deep-color region of the noise distribution Dt1 of FIG. 11A, is smaller than that of the noise distribution Dt2 of FIG. 11B. In a vicinity of the rear edge surface 14*a*, the color of the region near the rear edge surface 14*a* in the noise distribution Dt1 is deeper than the color of the region near the rear edge surface 14*a* in the noise distribution Dt2. Consequently, it is found that the noise, which is generated in the case that the first curved surface 142 and the second curved surface 143 are provided in the rear edge surface 14*a* of the vane 1 during the rotation of the impeller 200, is effectively prevented compared with the case that the first curved surface 142 and the second curved surface 143 are not provided in the rear edge surface 14*a* of the vane 1.

In the embodiment, the rear edge surface 14*a* includes both the first curved surface 142 and the second curved surface 143. The present invention is not limited to the embodiment. Alternatively, the rear edge surface 14*a* may include one of the first curved surface 142 and the second curved surface 143. In other words, the vane 1 may include only the first curved surface 142 or only the second curved surface 143 in the rear edge surface 14*a*. In sectional view from the direction in which the vane 1 extends, the vane 1 may include the rear surface 141 parallel to the axial direction and at least one of the first curved surface 142 and the second curved surface 143. Consequently, when the blower 100 is driven to rotate the impeller 200, turbulence is hardly generated near the rear edge surface 14*a* of the vane 1, which is on the opposite side to the rotation direction Dro of the impeller 200 in the circumferential direction. Thus, the generation of the noise due to the rotation of the impeller 200 can be prevented. A configuration in which the vane 1 includes neither the first curved surface 142 nor the second curved surface 143 in the rear edge surface 14*a* can be adopted in the case that the necessity of the prevention of the noise generated during the rotation of the impeller 200 is eliminated.

In the noise distribution Dt1 of FIG. 11A, the color of the region near the first curved surface 142 is paler than the color of the region near the second carved surface 143. That is, an effect that the first curved surface 142 prevents the noise is stronger than an effect that the second curved surface 143 prevents the noise. Preferably, the first curved surface 142 is provided in the rear edge surface 14*a* in the case that one of the first curved surface 142 and the second curved surface 143 is provided in the rear edge surface 14*a*. From the viewpoint of the prevention of the noise generated during the rotation of the impeller 200, preferably both the first curved surface 142 and the second curved surface 143 are provided in the rear edge surface 14*a*. A degree of the noise prevention effect is, in descending order, the configuration in which both the first curved surface 142 and the second curved surface 143 are provided in the rear edge surface 14*a*, the configuration in which the first curved surface 142 is provided in the rear edge surface 14*a*, the configuration in which the second curved surface 143 is provided in the rear edge surface 14*a*, and the configuration in which neither the first curved surface 142 nor the second curved surface 143 is provided in the rear edge surface 14*a*.

1-4. Modifications of Embodiment

In the embodiment, in sectional view from the circumferential direction, the portion facing the vane upper end surface 12 of the vane 1 and the vane upper end surface 12 of the inlet plate 481 extends straight in the radial direction. However the present invention is not limited to the embodiment.

Figure 12A:
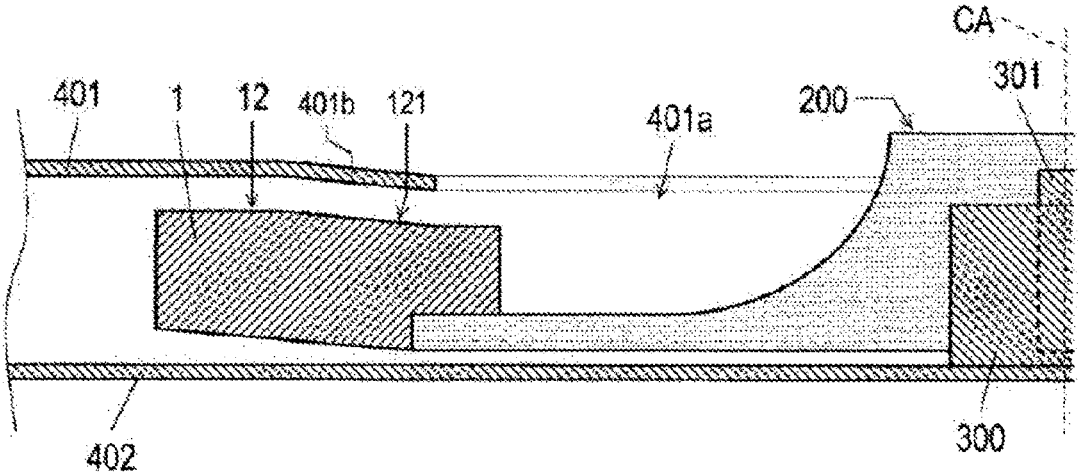
FIG. 12A is a sectional view illustrating a first modification of the configuration of the blower.

FIG. 12A is a sectional view illustrating a first modification of the configuration of the blower 100. As illustrated in FIG. 12A, the vane 1 further includes a fourth vane end surface 121. More specifically, the vane upper end surface 12 includes the fourth vane end surface 121. The fourth vane end surface 121 is located on the radially outer side with respect to the inlet port 401*a*. When viewed from the circumferential direction, the fourth vane end surface 121 is inclined onto the axial-direction upper side with respect to the plane PL orthogonal to the central axis CA toward the radially outer side. The inlet plate 401 further includes a first plate 401*b*. The first plate 401*b* is provided in parallel to the fourth vane end surface 121 on the axial-direction upper side with respect to the fourth vane end surface 121 of each of the plurality of vanes 1. Consequently, a gap between the vane 1 and the inlet plate 401 is relatively narrowed near the inlet port 401*a*, so that the counter flow of the air can be prevented in the gap.

Figure 12B:
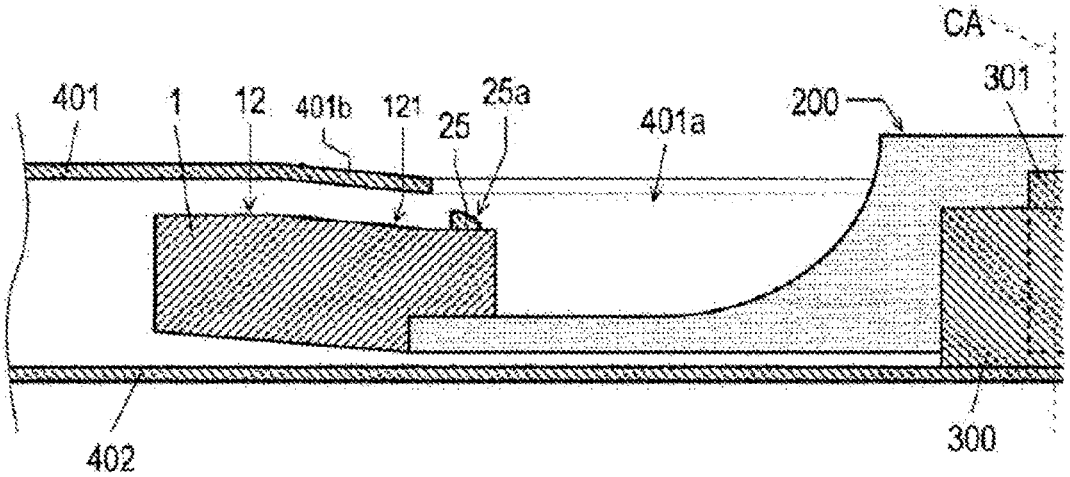
FIG. 12B is a sectional view illustrating another configuration of the first modification.

In the case that the impeller 200 includes the annular ring 25, the fourth vane end surface 121 may be located on the radially outer side with respect to the annular ring 25 as illustrated in FIG. 12B. Consequently, a gap between the annular ring 25 and the first plate 401*b* is relatively narrowed, so that the counter flow of the air can be prevented in the gap.

Figure 13A:
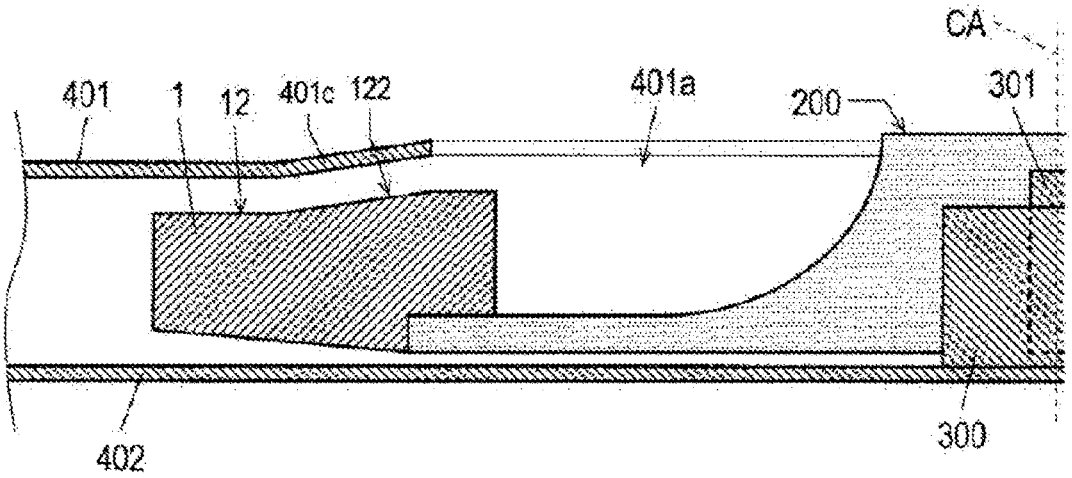
FIG. 13A is a sectional view illustrating a second modification of the configuration of the blower.
Figure 13B:
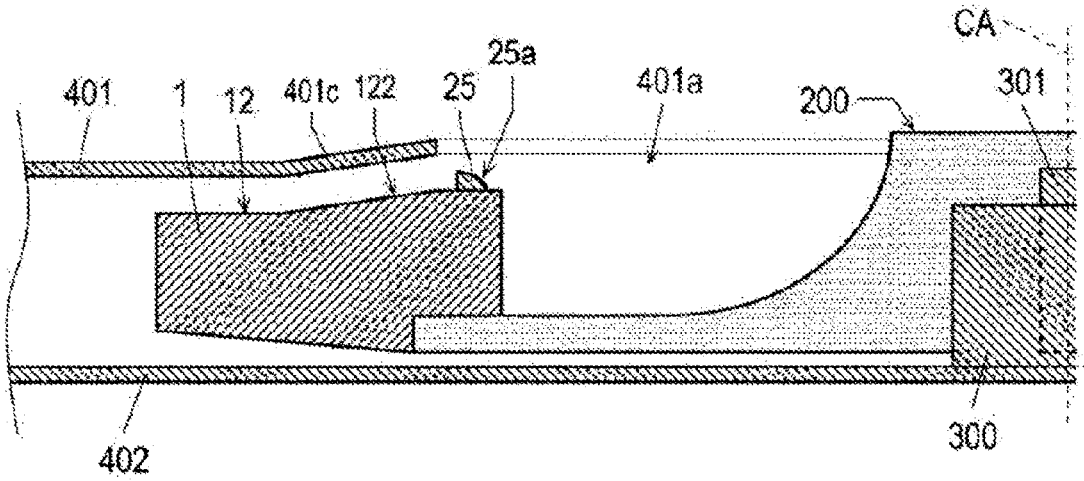
FIG. 13B is a sectional view illustrating another configuration of the second modification.

FIG. 13A is a sectional view illustrating a second modification of the configuration of the blower 100. As illustrated in FIG. 13A, the vane 1 further includes a fifth vane end surface 122. More specifically, the vane upper end surface 12 includes the fifth vane end surface 122. The fifth vane end surface 122 is located on the radially outer side with respect to the inlet port 401*a*. When viewed from the circumferential direction, the fifth vane end surface 122 is inclined onto the axial-direction lower side with respect to the plane PL orthogonal to the central axis CA toward the radially outer side. The inlet plate 401 further includes a second plate 401*c*. The second plate 401*c* is provided in parallel to the fifth vane end surface 122 on the axial-direction upper side with respect to the fifth vane end surface 122 of each of the plurality of vanes 1. In the case that the impeller 200 includes the annular ring 25, the fifth vane end surface 122 may be located on the radially outer side with respect to the annular ring 25 as illustrated in FIG. 13B. Consequently, because the air can efficiently be drawn from the inlet port 401*a*, the airflow of the blower 100 is easy to increase.

The first and second modifications are not limited to the illustrations in FIGS. 12A to 13B, but may appropriately be combined. For example, the inlet plate 401 may include the second plate 401*c* and the first plate 401*b* extending from the inner end on the radial-direction inside of the second plate 401*c* toward the radial-direction inside, and the vane upper end surface 12 may include the fifth vane end surface 122 and the fourth vane end surface 121 extending from the inner end on the radial-direction inside of the fifth vane end surface 122 toward the radial-direction inside. Consequently, the counter flow of the air can be prevented in the gap between the vane 1 and the inlet plate 401, and the counter flow of the air to the inlet port 401*a* can also be prevented.

1-5. Application Example of Blower

Figure 14A:
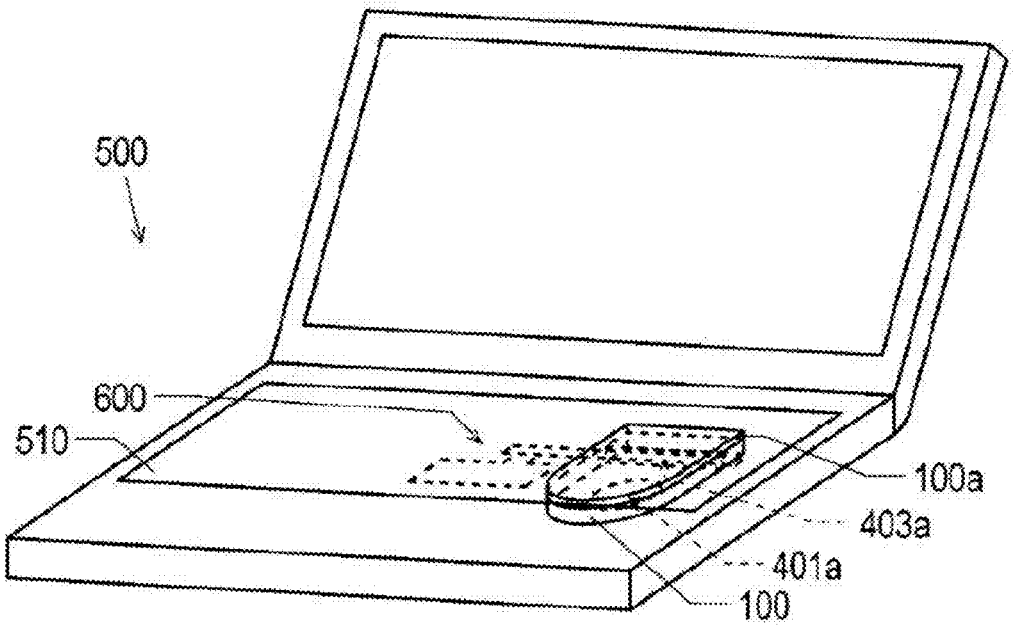
FIG. 14A is a perspective view illustrating an example of a laptop type information device on which the blower is mounted.
Figure 14B:
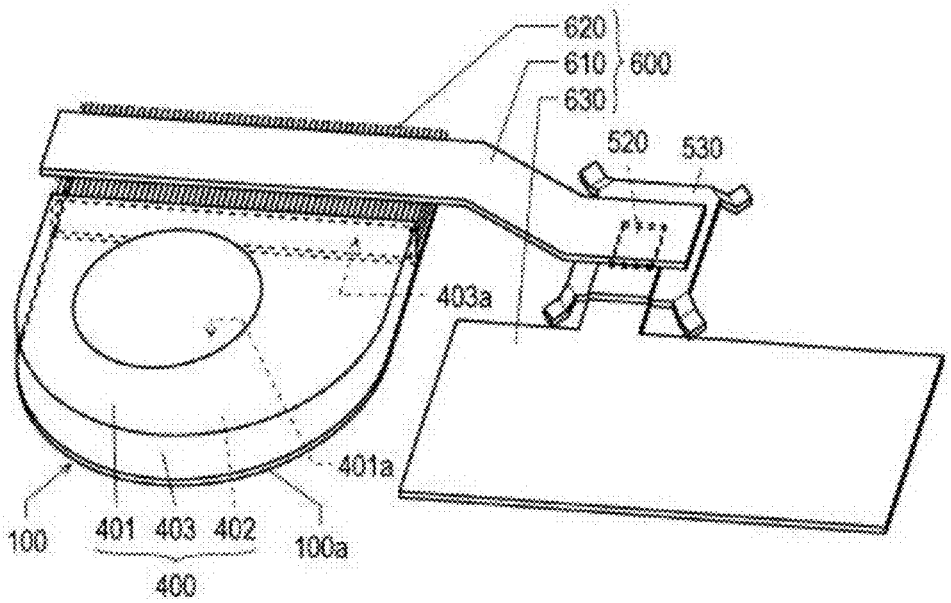
FIG. 14B is a perspective view illustrating a configuration example of the blower to which a heat pipe is attached.

An application example of the blower 100 will be described below. FIG. 14A is a perspective view illustrating an example of a laptop type information device 500 on which the blower 100 is mounted. FIG. 14B is a perspective view illustrating a configuration example of the blower 100 to which a heat pipe 600 is attached. The axial direction in FIG. 14A is reverse to that in FIGS. 1 to 13B. More specifically, the direction toward the upper side in FIG. 14A corresponds to the axial-direction lower side in FIGS. 1 to 13B, the direction toward the lower side in FIG. 14A corresponds to the axial-direction upper side in FIGS. 1 to 13B. The axial direction in FIG. 14B is identical to that in FIGS. 1 to 13B.

For example, the information device 500 is a low-profile personal computer such as a notebook personal computer. The blower 100 is used as a cooling fan for the information device 500, and mounted on the information device 500 together with a sheet-shape damper 100*a* and the heat pipe 600. For example, the blower 100 and the heat pipe 600 are attached to a rear surface of a keyboard 510 of the information device 500.

The damper 100*a* is a cushioning member that protects the blower 100 from a shock. The damper 100*a* is provided in the bottom surface in the axial direction of the blower 100. The blower 100 is attached to the rear surface of the keyboard 510 with the damper 100*a* interposed therebetween.

The heat pipe 600 is a member that conducts heat generated from the inside and a heat generation portion of the information device 500. In FIG. 14B, the heat pipe 600 conducts the heat generated from the blower 100 and a CPU 520 mounted on the information device 500. The heat pipe 600 includes a heat transfer sheet 610, a heat sink 620, and a heat spreader 630.

The heat transfer sheet 610 is a belt-shape heat conduction member, and conducts the heat of the CPU 520 disposed on a base 530 to the heat sink 620. One end of the heat transfer sheet 610 adheres to the heat sink 620 in a heat conductive manner, and the other end of the heat transfer sheet 610 adheres to the CPU 520 in a heat conductive manner with the heat spreader 630 interposed therebetween.

The heat sink 620 is provided in the blowing port 403*a* of the blower 100 so as to blow air, and radiates the heat conducted from the heat transfer sheet 610 to the air blown from blowing port 403*a*.

The heat spreader 630 is a sheet-shape heat conduction member. A part of the heat spreader 630 adheres to the CPU 520 in a heat conductive manner. Another part of the heat spreader 630 adheres to, for example, the rear surface of the keyboard 510 in a heat conductive manner. The heat spreader 630 conducts the heat of the CPU 520 to a casing (not illustrated) of the information device 500 and the air blown by the blower 100.

At least one of the inlet plate 401, the support plate 402, and the sidewall 403 of the blower 100 may be connected to the heat pipe 600 in a heat conductive manner by soldering or a heat conductive both-sided or single-sided adhesive tape. At least one of the inlet plate 401, the support plate 402, and the sidewall 403 of the blower 100 may be connected to one end of the heat transfer sheet 610 in a heat conductive manner by soldering or the adhesive tape. Alternatively, one end of the heat transfer sheet 610 may adhere to at least one of the inlet plate 401, the support plate 402, and the sidewall 403 of the blower 100 in a heat conductive manner. Consequently, the heat pipe 600 can efficiently conduct the heat to the housing 400 of the blower 100. Thus, the blower 100 can also radiate the heat generated in the CPU 520 to the efficiently-blown air, and emit the heat to the outside of the information device 500.

2. Others

The embodiment of the present invention has been described above. The scope of the present invention is not limited to the embodiment. Various modifications can be made without departing from the scope of the present invention. The items described in the embodiment can arbitrarily be combined as appropriate within a consistent range.

For example, the present invention is useful as a low-profile blower fan. However, the present invention is not limited to the blower fan.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A blower comprising:

an impeller rotatable about a central axis;

a motor that drives the impeller; and a housing that accommodates the impeller and the motor, wherein the impeller includes:

a plurality of vanes arrayed in a circumferential direction;

a cover constitutes at least a portion of an internal space in which an upper end on an axial-direction upper side of the motor is accommodated; and a flange in which the plurality of vanes are provided at an outer circumferential edge on a radially outer side, the housing includes a first housing that faces a vane lower end surface located on an axial-direction lower side of the plurality of vanes with a first gap interposed therebetween, and the vane lower end surface includes a first vane end surface in which a shortest distance to the first housing in an axial direction increases toward the radially outer side, an upper end on an axial-direction upper side of the cover is arranged at a level higher than an inlet plate, wherein when viewed from the circumferential direction, the first vane end surface extends from an outside surface located on the radially outer side of the flange, and is inclined onto an axial-direction upper side with respect to a plane orthogonal to the central axis toward the radially outer side, wherein the first vane end surface extends from an end on the axial-direction lower side of the outside surface located on the radially outer side of the flange.

2. The blower according to claim 1, wherein an axial-direction length of an outer end on the radially outer side of the plurality of vanes is larger than an axial-direction length of an inner end on a radially inner side of the plurality of vanes.

3. The blower according to claim 1, wherein the first vane end surface forms an acute angle of 0.5 degrees to 10 degrees with respect to a plane orthogonal to the central axis when viewed from the circumferential direction.

4. The blower according to claim 1, wherein each vane includes a third vane end surface extending from an outer end on the radially outer side of the first vane end surface toward at least an axial-direction upper side.

5. The blower according to claim 4, wherein when viewed from the circumferential direction, the third vane end surface is parallel to the axial direction.

6. The blower according to claim 4, wherein when viewed from the circumferential direction, the third vane end surface extends straight, and is inclined onto the axial-direction upper side with respect to a plane orthogonal to the central axis toward the radial-direction outside.

7. The blower according to claim 4, wherein when viewed from the circumferential direction, the third vane end surface has a curved shape projecting toward the radially outer side and the axial-direction lower side.

8. The blower according to claim 1, wherein an inner end on a radially inner side of the plurality of vanes projects from the flange toward an axial-direction upper side at the outer circumferential edge of the flange.

9. The blower according to claim 1, wherein at least one of the plurality of vanes is made of resin, and is unitary with the flange.

10. The blower according to claim 1, wherein a shortest distance in a radial direction from the central axis to an outer end on the radially outer side of the plurality of vanes is at least five times an axial-direction length of the blower.

11. The blower according to claim 1, wherein each vane is curved in the circumferential direction when viewed from the axial direction, and when viewed from the axial direction, a length along the each vane from an outside surface located on the radially outer side of the flange to an outer end on the radially outer side of the plurality of vanes is longer than an axial-direction length of the each vane in an outside surface located on the radially outer side of the flange.

12. The blower according to claim 1, wherein each vane includes a rear edge surface located on an opposite side to a rotation direction of the impeller in the circumferential direction, the rear edge surface includes a rear surface parallel to the axial direction in sectional view from a direction in which the vane extends and at least one of a first curved surface and a second curved surface, the first curved surface has a curved shape projecting toward an opposite direction to the rotation direction in the circumferential direction and the axial-direction upper side, and is connected to an end on the axial-direction upper side of the rear surface, and the second curved surface has a curved shape projecting toward the opposite direction to the rotation direction in the circumferential direction and the axial-direction lower side, and is connected to an end on the axial-direction one side of the rear surface.

13. The blower according to claim 1, wherein the housing further includes a second housing facing a vane upper end surface located on an axial-direction upper side of the vane with a second gap interposed therebetween, and the second housing includes an inlet port piercing in the axial direction.

14. The blower according to claim 13, wherein an inner end on a radially inner side of the plurality of vanes overlaps the inlet port when viewed from the axial direction.

15. The blower according to claim 13, wherein the vane upper end surface includes a fourth vane end surface located on the radially outer side with respect to the inlet port, when viewed from the circumferential direction, the fourth vane end surface is inclined onto the axial-direction upper side with respect to a plane orthogonal to the central axis toward the radially outer side, and the second housing further includes a first plate provided in parallel to the fourth vane end surface on the axial-direction upper side with respect to the fourth vane end surface of each of the plurality of vanes.

16. The blower according to claim 13, wherein the vane upper end surface includes a fifth vane end surface located on the radially outer side with respect to the inlet port, when viewed from the circumferential direction, the fifth vane end surface is inclined onto the axial-direction lower side with respect to a plane orthogonal to the central axis toward the radially outer side, and the second housing further includes a second plate provided in parallel to the fifth vane end surface on the axial-direction other side with respect to the fifth vane end surface of each of the plurality of vanes.

* * * * *